US010653207B1

(12) United States Patent
Ochipa et al.

(10) Patent No.: US 10,653,207 B1
(45) Date of Patent: May 19, 2020

(54) PLIANT LAYER PEELABLY ADHERED TO AN OUTSOLE OF A SHOE

(71) Applicant: S9, LLC, Bonita Springs, FL (US)

(72) Inventors: Matthew Ochipa, Fort Myers, FL (US); John M. Chenciner, Naples, FL (US)

(73) Assignee: S9, LLC, Bonita Springs, FL (US)

( * ) Notice: Subject to any disclaimer, the term of this patent is extended or adjusted under 35 U.S.C. 154(b) by 0 days.

(21) Appl. No.: 16/206,772

(22) Filed: Nov. 30, 2018

(51) Int. Cl.

| | |
|---|---|
| ***A43C 13/00*** | (2006.01) |
| ***A43B 13/36*** | (2006.01) |
| ***A43B 13/32*** | (2006.01) |
| ***A43B 13/12*** | (2006.01) |
| ***A43C 13/12*** | (2006.01) |

(52) U.S. Cl.
CPC ..... *A43B 13/36* (2013.01); *A43B 13/122* (2013.01); *A43B 13/32* (2013.01); *A43C 13/12* (2013.01)

(58) Field of Classification Search
CPC ..... A43B 13/12; A43B 13/36; A43C 13/12; A43C 13/00
USPC ..... 36/15, 73
See application file for complete search history.

(56) References Cited

U.S. PATENT DOCUMENTS

| | | | | |
|---|---|---|---|---|
| 3,561,140 | A * | 2/1971 | Ludwig | A43C 15/02 36/59 R |
| 3,693,269 | A * | 9/1972 | Guarrera | A43B 13/32 36/15 |
| 3,903,620 | A * | 9/1975 | Gillet | A43C 13/12 36/25 R |
| 5,771,605 | A | 6/1998 | Safdie | |
| 6,460,273 | B2 * | 10/2002 | Witjes | A43B 13/00 36/15 |
| 6,640,465 | B1 * | 11/2003 | Burgess | A43B 7/141 36/15 |
| 6,684,442 | B1 * | 2/2004 | Parker | A43B 3/106 12/142 R |
| 7,191,551 | B2 * | 3/2007 | O'Connor | A43B 3/108 206/278 |
| 7,377,054 | B2 * | 5/2008 | Milner | A43B 1/0045 36/11.5 |
| 7,559,159 | B1 * | 7/2009 | Lundberg | A43B 3/163 36/7.1 R |
| 8,677,651 | B2 * | 3/2014 | Cross | A41B 11/10 36/11.5 |
| 2005/0011084 | A1 * | 1/2005 | Stephenson | A43B 1/0045 36/15 |
| 2005/0150137 | A1 * | 7/2005 | Steidle | A43C 11/00 36/136 |
| 2005/0274042 | A1 * | 12/2005 | Issler | A43B 1/0081 36/15 |
| 2006/0053660 | A1 * | 3/2006 | Lewton | A43B 7/1445 36/59 R |
| 2006/0112591 | A1 | 6/2006 | Lombardo | |

(Continued)

OTHER PUBLICATIONS

Flexcon. Topcoat Film Adhesive Liner: Adhesive Selection Guide. Website: https://static1.squarespace.com/static/5705a9ee7da24fd944e0a5c9/t/57dab9a74402430965fbe446/1473952168269/Flexcon_Adhesive+Guide.pdf, originally downloaded Nov. 30, 2018, 11 pages.

*Primary Examiner* — Marie D Bays
(74) *Attorney, Agent, or Firm* — Craig R. Miles; CR Miles P.C.

(57) ABSTRACT

A shoe including a pliable layer conformably peelably adhered in generally matched engagement with the outsole periphery of the ground engageable surface of the outsole of the shoe.

15 Claims, 11 Drawing Sheets

(56) References Cited

U.S. PATENT DOCUMENTS

| | | | | |
|---|---|---|---|---|
| 2007/0119723 | A1* | 5/2007 | Smith | A43D 999/00 206/38 |
| 2008/0163518 | A1* | 7/2008 | Pettis | A43B 13/22 36/30 R |
| 2008/0301976 | A1* | 12/2008 | Li | A43B 1/06 36/73 |
| 2011/0047815 | A1* | 3/2011 | Asquith | A43B 17/105 36/15 |
| 2011/0225847 | A1* | 9/2011 | Buchanan | A43B 5/08 36/96 |
| 2013/0042422 | A1* | 2/2013 | Neal | A43B 1/0072 12/103 |
| 2014/0041257 | A1* | 2/2014 | Robinson | A43B 3/244 36/100 |
| 2014/0048214 | A1* | 2/2014 | Dhillon | A43D 11/003 156/760 |
| 2014/0215860 | A1* | 8/2014 | Moorman | A43B 1/0054 36/25 R |
| 2014/0230275 | A1* | 8/2014 | Matheny | A43B 3/163 36/73 |
| 2016/0143508 | A1* | 5/2016 | McGrath | A43B 13/36 15/104.002 |
| 2017/0318909 | A1* | 11/2017 | Gilbert | A43B 13/32 |
| 2018/0235316 | A1* | 8/2018 | Gonzalez de los Santo | C09J 5/06 |

* cited by examiner

PLIANT LAYER PEELABLY ADHERED TO AN OUTSOLE OF A SHOE

I. FIELD OF THE INVENTION

A shoe including a pliable layer conformably peelably adhered in generally matched engagement with the outsole periphery of the ground engageable surface of the outsole of the shoe.

II. SUMMARY OF THE INVENTION

Accordingly, a broad object of the present invention can be to provide a shoe including one or more of: an upper secured to an outsole, a pliable layer having a first surface opposite a second surface extending to a pliable layer periphery generally matched to an outsole periphery of a ground engageable surface of the outsole, and an adhesive layer disposed on the first or second surface of the pliable layer or on the ground engageable surface of the outsole, where the pliable layer conformably peelably adhered to the ground engageable surface of the outsole and the pliable layer periphery disposed in generally matched engagement with the outsole periphery of the ground engageable surface of the outsole.

Another broad object of the present invention can be to provide a method of making a shoe including one or more of: securing an upper to an outsole, configuring a pliable layer conformable to the outsole, the pliable layer having a first surface opposite a second surface extending to a pliable layer periphery generally matched to an outsole periphery, disposing an adhesive layer on the first or second surface of the pliable layer or the outsole, and conformably peelably adhering the pliable layer to the outsole, the pliable layer periphery in generally matched engagement with the outsole periphery.

Another broad object of the present invention can be a method of using a shoe including one or more of: transporting a shoe from a first location to a second location, the shoe including one or more of: an upper secured to an outsole, a pliable layer conformably peelably adhered to the ground engageable surface of the outsole and the pliable layer periphery disposed in generally matched engagement with the outsole periphery of the ground engageable surface of the outsole, and peeling the pliable layer from the outsole of the shoe prior to or after a wearer wears the shoe.

Naturally, further objects of the invention are disclosed throughout other areas of the specification, drawings, photographs, and claims.

III. BRIEF DESCRIPTION OF THE DRAWINGS

IV. DETAILED DESCRIPTION OF THE INVENTION

Figure 1:
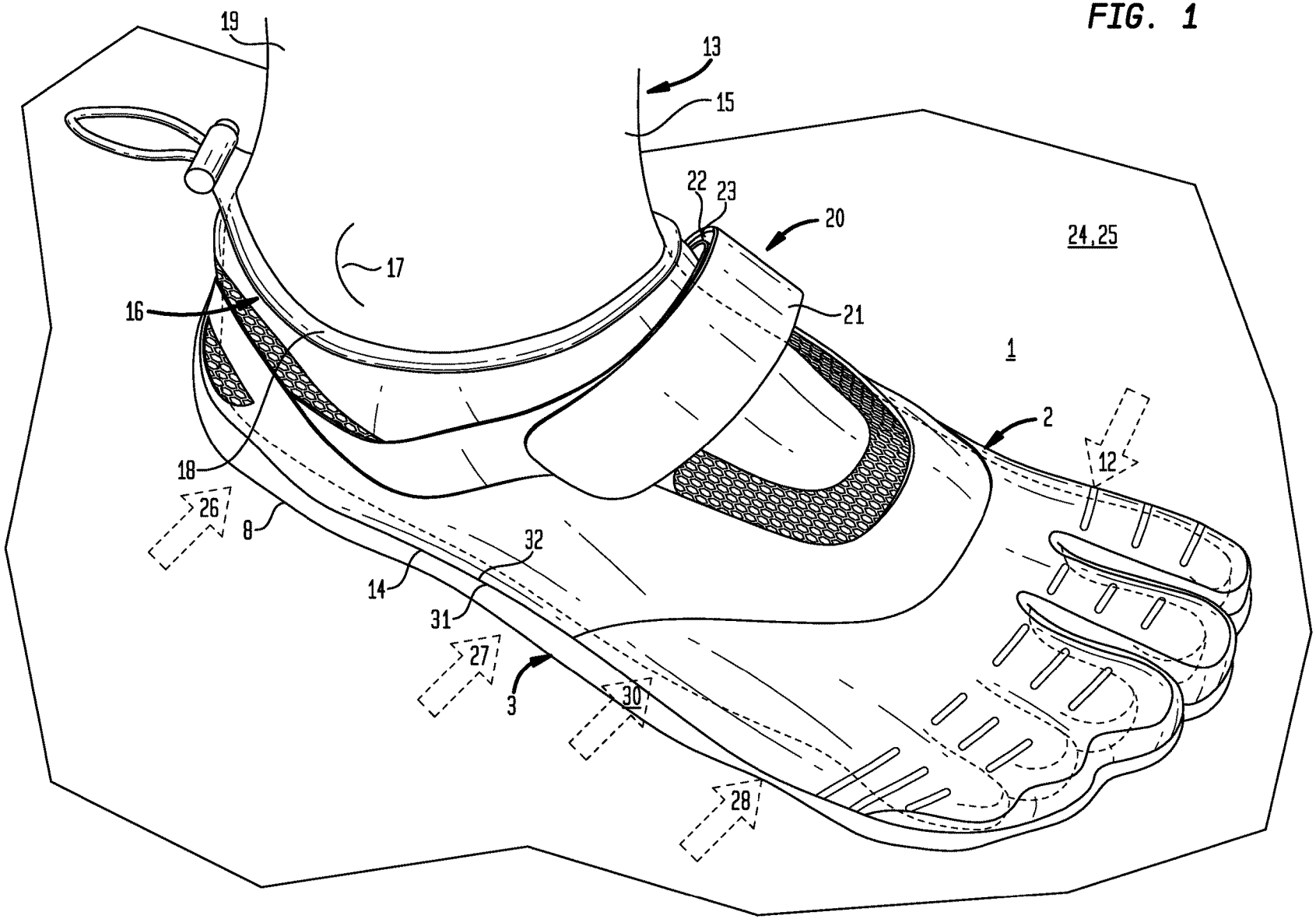
FIG. 1 is a top perspective view of a particular embodiment of a shoe including a pliable layer.
Figure 2:
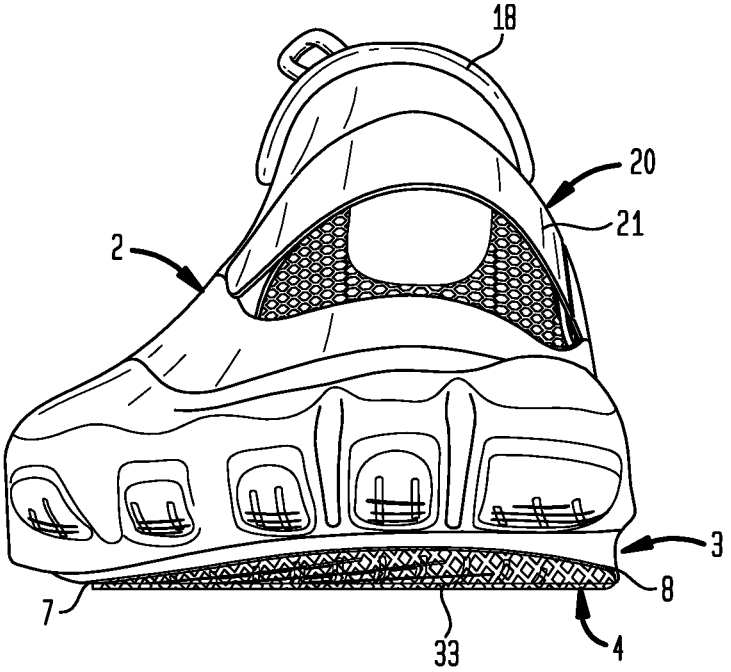
FIG. 2 is a front elevation view of a particular embodiment of a shoe including a pliable layer.
Figure 3:
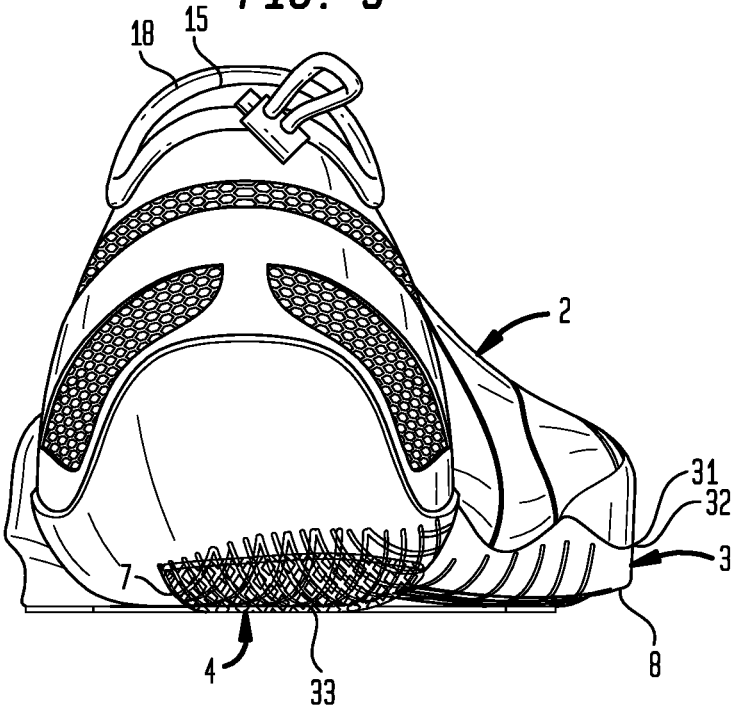
FIG. 3 is a back elevation view of a particular embodiment of a shoe including a pliable layer.
Figure 4:
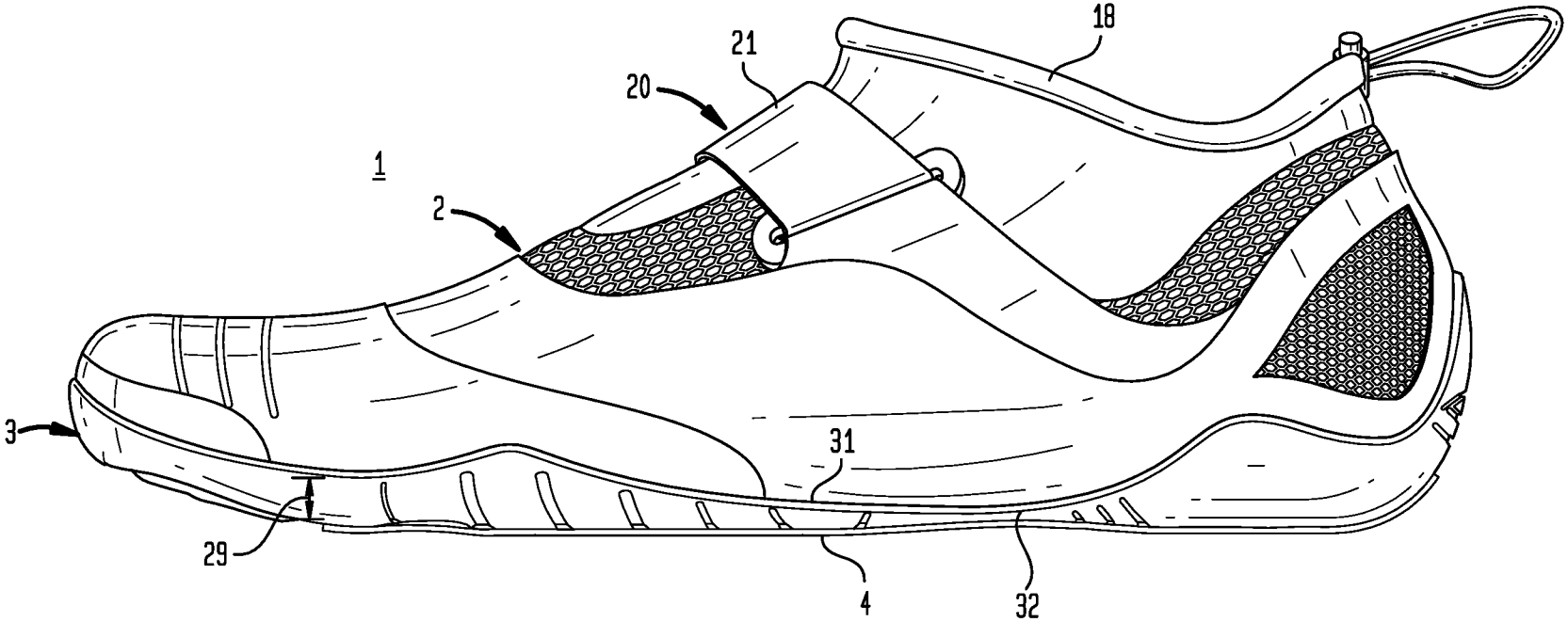
FIG. 4 is a first side elevation view of a particular embodiment of a shoe including a pliable layer.
Figure 5:
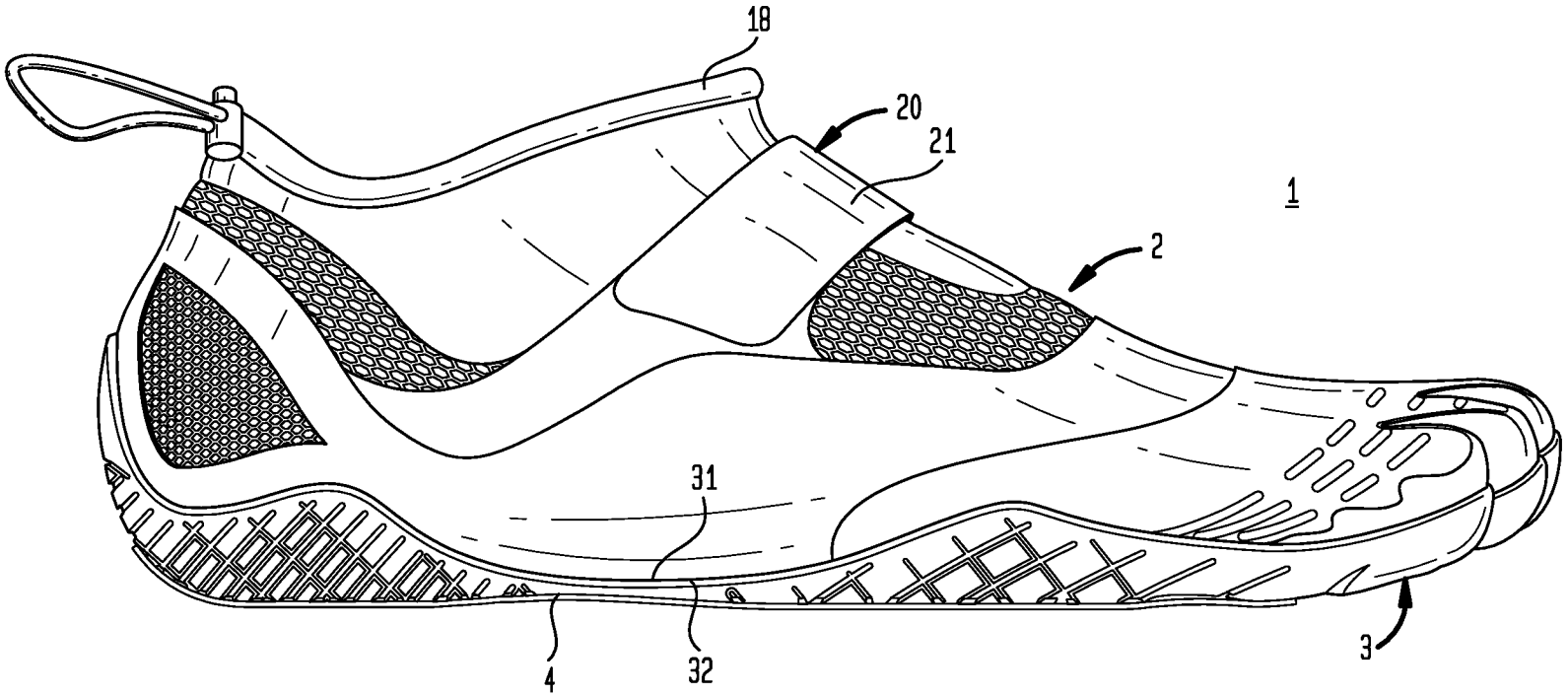
FIG. 5 is a second side elevation of a particular embodiment of a shoe including a pliable layer.
Figure 6:
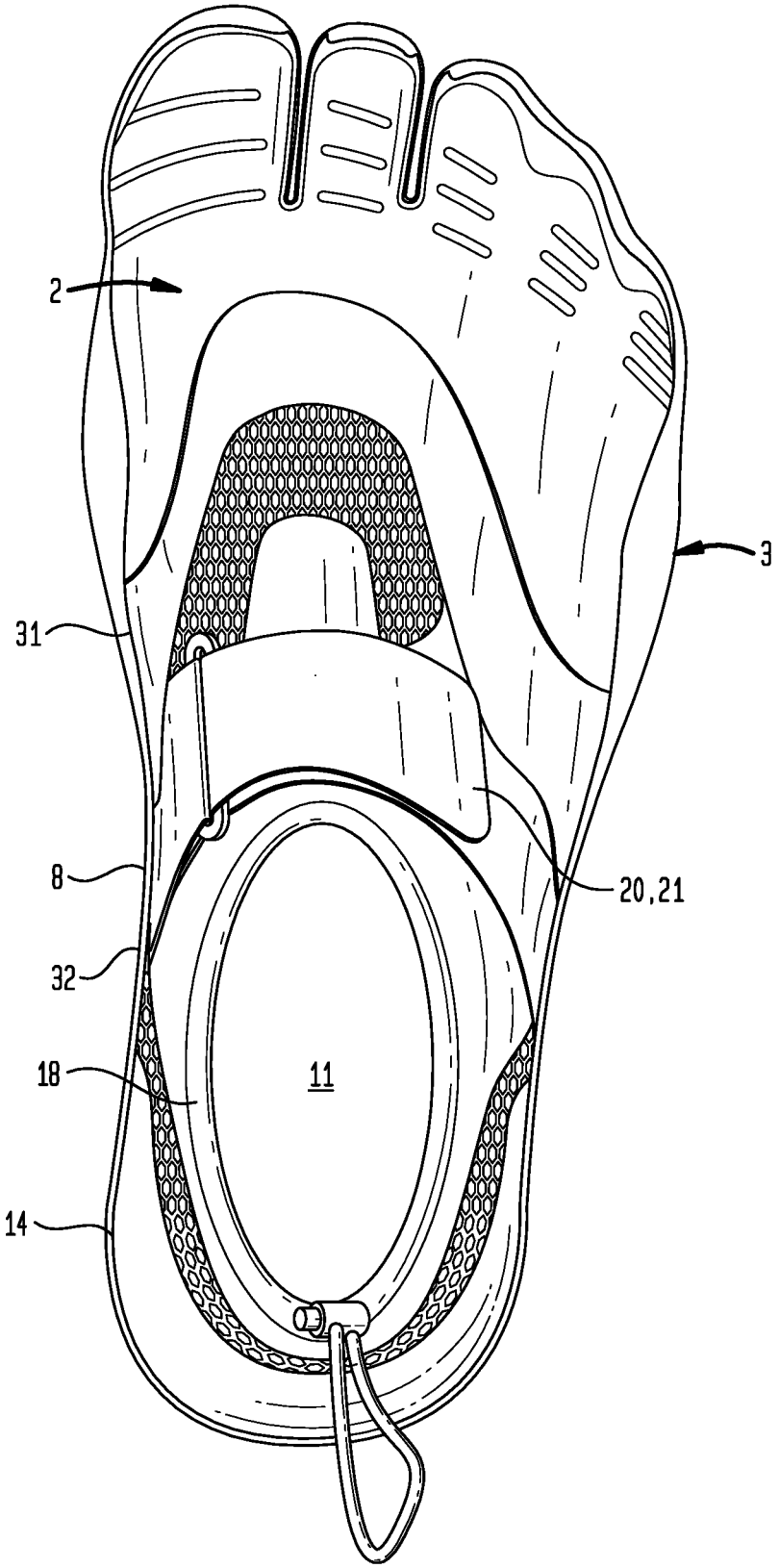
FIG. 6 is a top plan view of a particular embodiment of a shoe including a pliable layer.

Generally with reference to FIGS. 1 through 11, embodiments of a shoe (1) can include one or more of: an upper (2) which can be secured to an outsole (3), a pliable layer (4) having a first surface (5) opposite a second surface (6) extending to a pliable layer periphery (7) generally matched to an outsole periphery (8) of a ground engageable surface (9) of the outsole (3) of the shoe (1), an adhesive layer (10) disposed on the first surface (5) or the second surface (6) of the pliable layer (4) or on the ground engageable surface (9) of the outsole (3) of the shoe (1), and the pliable layer (4) conformably peelably adhered to the ground engageable surface (9) of the outsole (3) of the shoe (1), the pliable layer periphery (7) disposed in generally matched engagement with the outsole periphery (8) of the ground engageable surface (9) of the outsole (3).

Now referring primarily to FIGS. 1 through 7A, in particular embodiments, the shoe (1) can include an upper (2) secured to an outsole (3). The upper (2) secured to the outsole (3) can define an inside space (11) to receive a foot (12) of a wearer (13). The upper (2) can upwardly extend from an upper perimeter (14) secured to the outsole (3) to terminate in a top line (15) which defines an aperture (16) of sufficient dimension to receive the wearer's foot (12). In the illustrative example of FIG. 1, the top line (15) surrounds the wearer's ankle (17). A collar (18) can be joined to the top line (15) of the upper (2); although this illustrative embodiment is not intended to preclude other configurations of the upper (2) which may be configured to extend further up the leg (19) of the wearer (13) or only partially cover the wearer's toes, top of the foot, or heel, or various combinations thereof. In particular embodiments, the outsole (3) may be produced separate and the upper (2) can be optional.

Again, referring primarily to FIGS. 1 through 7A, embodiments of the upper (2) can further include one or more upper fasteners (20) operable to conform the upper (2) about the wearer's foot (12). In particular embodiments, the upper fasteners (20) can be a series of pairs of eyelets which receive a lace where the lace ends can be drawn to conform the upper (2) about the wearer's foot (12). In the illustrative examples of FIGS. 1 through 8, a strap (21) can be adjustably disposed on the upper (2) by way of engageable hook (22) and loop (23); however, this illustrative embodiment is not intended to preclude embodiments which include other types of upper fasteners (20), such as: buttons, zippers, buckles, straps, or the like, and combinations thereof.

The upper (2) can comprise any one or a combination of materials such as a fabric of woven fibers (whether natural or synthetic), leather, pleather, patent leather, plastic, or other like material.

Again, referring primarily to FIGS. 1 through 7A, the outsole (3) refers to the part of the shoe (1) engageable to a support surface (24) or the ground (25) during normal use. The outsole (3) can be made from one piece or from a plurality of pieces. As to certain embodiments, the heel portion (26) of the outsole (3) may be made of a different material than the midfoot portion (27) of the outsole (3) or forefoot portion (28) of the outsole (3). The outsole (3) can have a height (29) disposed between a ground engageable surface (9) of the outsole (3) which contacts the support surface (24) and an outsole inner surface (30) which faces the upper (2). The outsole (3) can be secured to the upper (2) (typically the upper periphery (31) secured to the outsole perimeter (32)) by an adhesive, stitching, or other suitable securement means.

The outsole (3) can be made from natural materials such as: leather, wood, or natural rubber, or from synthetic materials such as: styrene butadiene rubber, nitrile-butadiene rubber, polyvinyl chloride, polyurethane, neoprene, polyether, polyester, or the like, or combinations thereof, whether as a solid material or as a foam, thermofoam, closed cell foam, or layers or combinations thereof. In particular embodiments, the outsole (3) can be translucent, transparent, or partially translucent or transparent.

Now referring to FIGS. 1 through 10, particular embodiments of the shoe (1) can include a pliable layer (4). The pliable layer (4) can include a first surface (5) opposite a second surface (6). The first surface (5) and second surface (6) can extend to a pliable layer periphery (7). The pliable layer periphery (7) can generally match to the outsole periphery (8) of the ground engageable surface (9) of the outsole (3). However, in particular embodiments the pliable layer periphery (7) may not generally match to the outsole periphery (8) of the ground engageable surface (9) of the outsole (3). In particular embodiments, the pliable layer periphery (7) can match the entirety or a portion of the outsole periphery (8). In further particular embodiments, the pliable layer periphery (7) may not match the outsole periphery (8).

In particular embodiments, the pliable layer (4) can, but need not necessarily, be a generally uniform sheet of material (33). Upon application of the pliable layer (4) to the ground engageable surface (9) of the outsole (3), the generally uniform sheet of material (33) can conform to the outsole periphery (8) of the ground engageable surface (9) of the outsole (3). As shown in the illustrative example of FIG. 7, in particular embodiments, the generally uniform sheet of material (33) can sufficiently conform to the ground engageable surface (9) of the outsole (3) or be sufficiently thin or transparent to allow visualization of the ground engageable surface (9) of the outsole (3) through the pliable layer (4). In particular embodiments, the visualization of the ground engageable surface (9) of the outsole (3) can be a visualization of the tread pattern (47) disposed on the ground engageable surface (9) of the outsole (3).

Again, referring to FIGS. 1 through 10, the pliable layer (4) can further include a plurality of patterned surface elements (34). The patterned surface elements (34) can be disposed on the first surface (5) or the second surface (6) of the pliable layer (4). The patterned surface elements (34) can, but need not necessarily, include a plurality of repeating pliable layer pattern, whether woven fibers, or raised or recessed impressions which extend across the first or second surface (5)(6) (or both surfaces) of the pliable layer (4). The repeating pliable layer patterns (35) can, but need not necessarily, be tesselate.

In particular embodiments, the plurality of patterned surface elements (35) can be a raised thickness pliable layer pattern (36). The patterned surface elements (35) of the raised thickness pliable layer pattern (36) can each include a central portion (37) extending outward from the pliable layer (4). Between each of the central portions (37) of the patterned surface elements (35) can be a border recess (38) defining the geometric configuration (39) of each of the plurality of patterned surface elements (35). Each border recess (38) can have a thickness less than the thickness of the central portion (37) of each of the patterned surface elements (35).

In particular embodiments, the plurality of patterned surface elements (35) can comprise a reduced thickness pliable layer pattern (40). A reduced thickness pliable layer pattern (40) can include a repeating plurality of recessed pattern surface elements (41). The plurality of repeating recessed pattern surface elements (41) can each extend to and be enclosed by a patterned wall element (42) or interconnected network of wall elements (43). In particular embodiments, the patterned wall element (42) can be flush with or can extend a distance from the first or second surface (5)(6) of the pliable layer (4). The patterned wall element (42) can define a geometric configuration (39) of the recessed pattern surface element (41) and an interior space (44) bounded by the configuration of the patterned wall element (42) and a bottom surface (45) of the recessed pattern surface element (41). In particular embodiments, the bottom surface (45) of the recessed patterned surface element (41) can further define or include a pattern aperture (46). The pattern aperture (46) can be open to the first surface (5) and the second surface (6) of the pliable layer (4). The pattern apertures (46) can permit visualization of the tread pattern (47) on the ground engageable surface (9) of the outsole (3). In yet further embodiments, the reduced thickness pliable layer pattern (40) can include a plurality of repeating geometric configurations (39) having a mixture of pattern apertured and pattern non-apertured bottom surfaces (45).

Figure 7A:
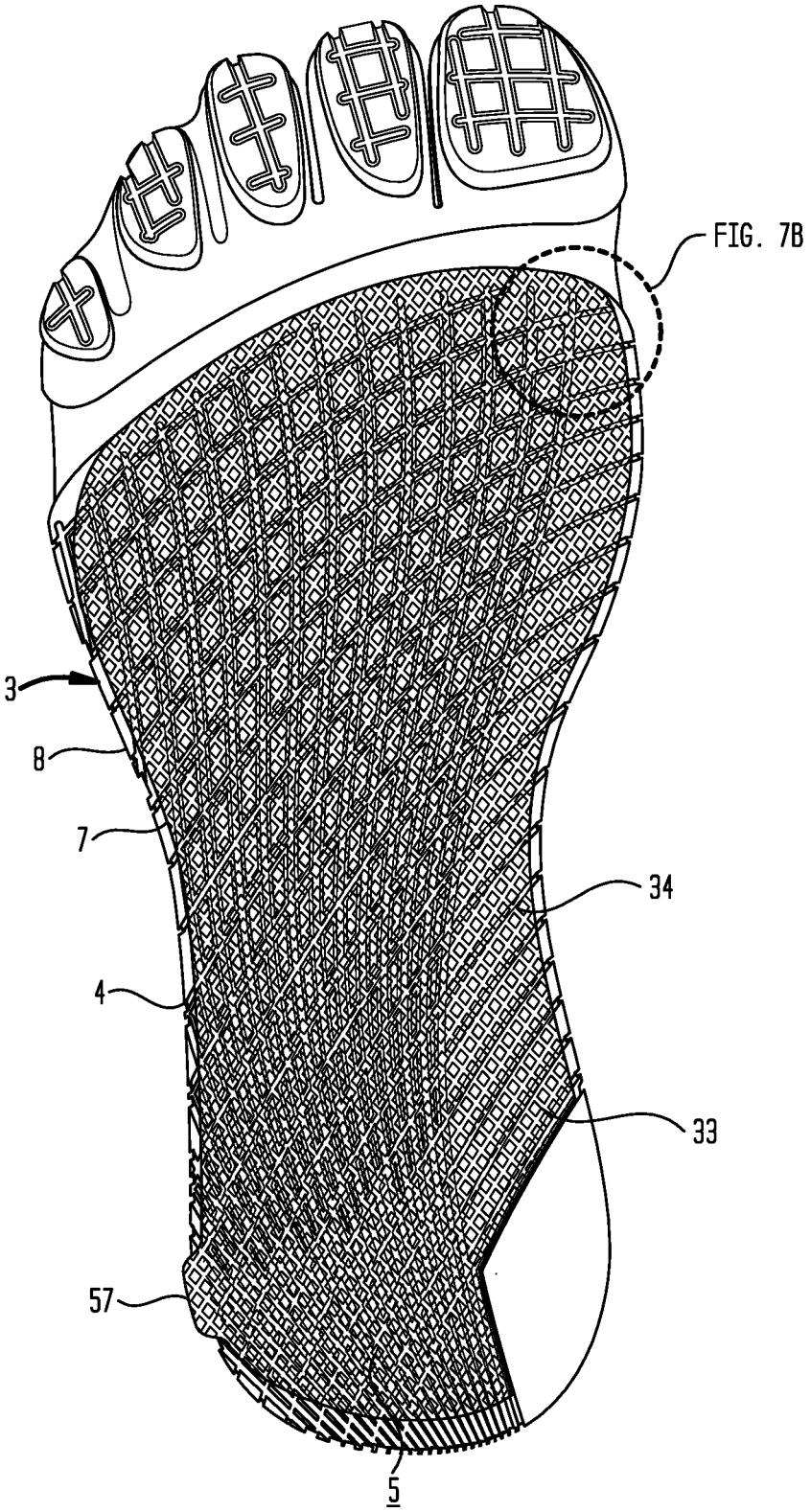
FIG. 7A is a bottom plan view of a particular embodiment of a shoe including a pliable layer.
Figure 7B:
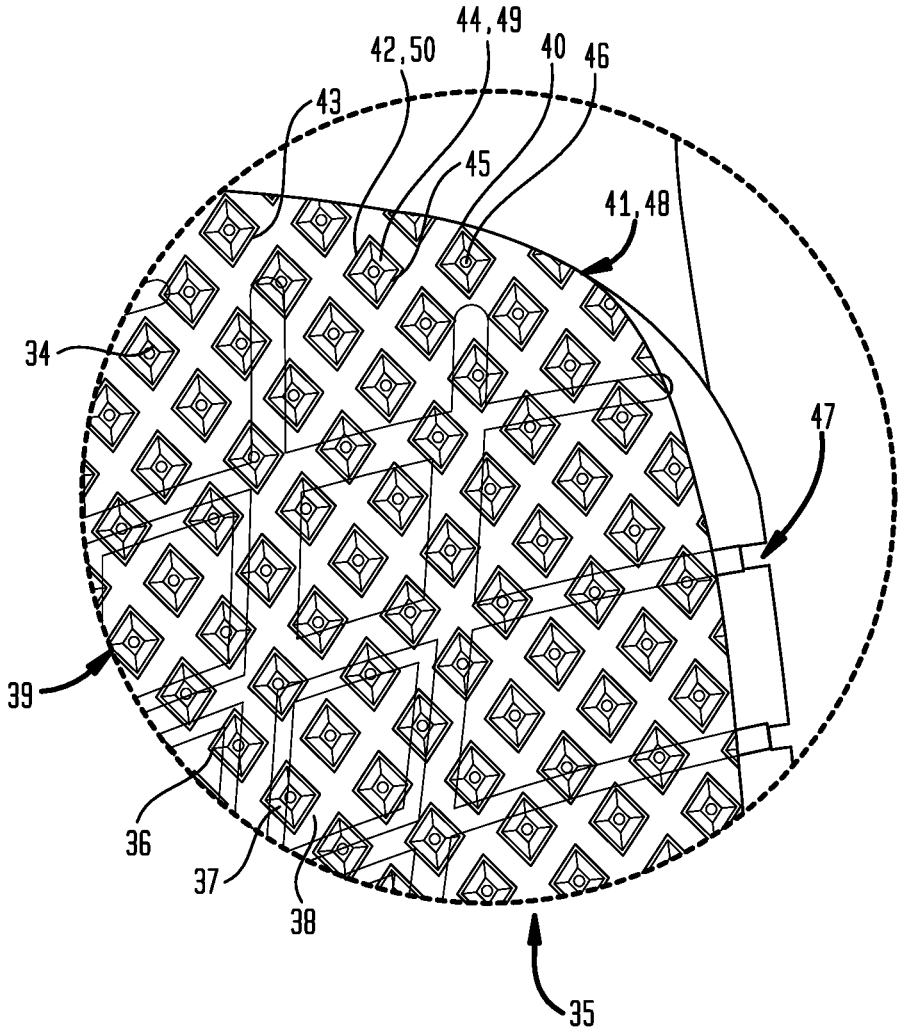
FIG. 7B is an enlarged view of a portion of FIG. 7A.

In the exemplary embodiment of FIG. 7B, the repeating plurality of patterned surface elements (35) can be a repeating plurality diamond recessed patterned surface elements (48) which extend across the first surface (5) or the second surface (6) (or both) of the pliable layer (4). Each of the plurality of repeating diamond recessed patterned surface elements (48) can extend to a patterned wall element (42) defining a diamond interior space (49) bounded by diamond patterned wall element (50) and the bottom surface (45) of the diamond recessed patterned surface elements (35). The thickness of the diamond patterned wall element (50) can be greater than the thickness of the bottom surface (45) of the diamond recessed patterned surface element (48), thereby producing a reduced thickness pliable layer pattern (40).

The pliable layer (4) can be selected from the group consisting of: velvet, cotton, knit fabric, woven fabric, suede, nylon, rayon, linen, LYCRA, canvas, jersey, silk, lace, netted fabric, wool, synthetic fabric, tweed, jacquard, leather, microfiber, poplin, fleece, or other like materials, or a combination thereof.

Figure 9:
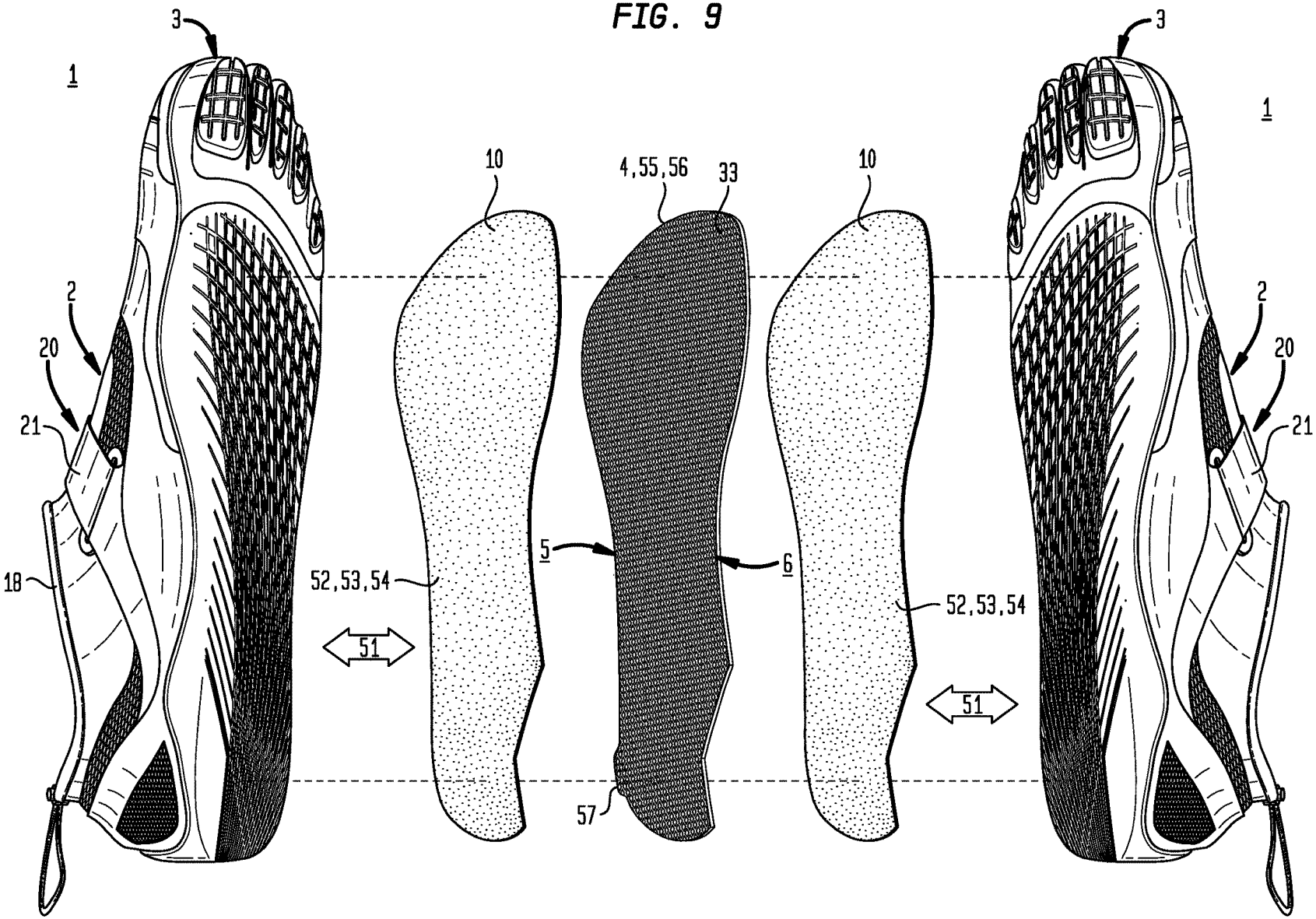
FIG. 9 is an illustrative exploded view of a particular embodiment of method of making a shoe including a pliable layer having an outsole engaging first surface adherable to a ground engageable surface of the outsole of a left shoe and having an outsole engaging second surface adherable to a ground engagable surface of a right shoe.
Figure 10:
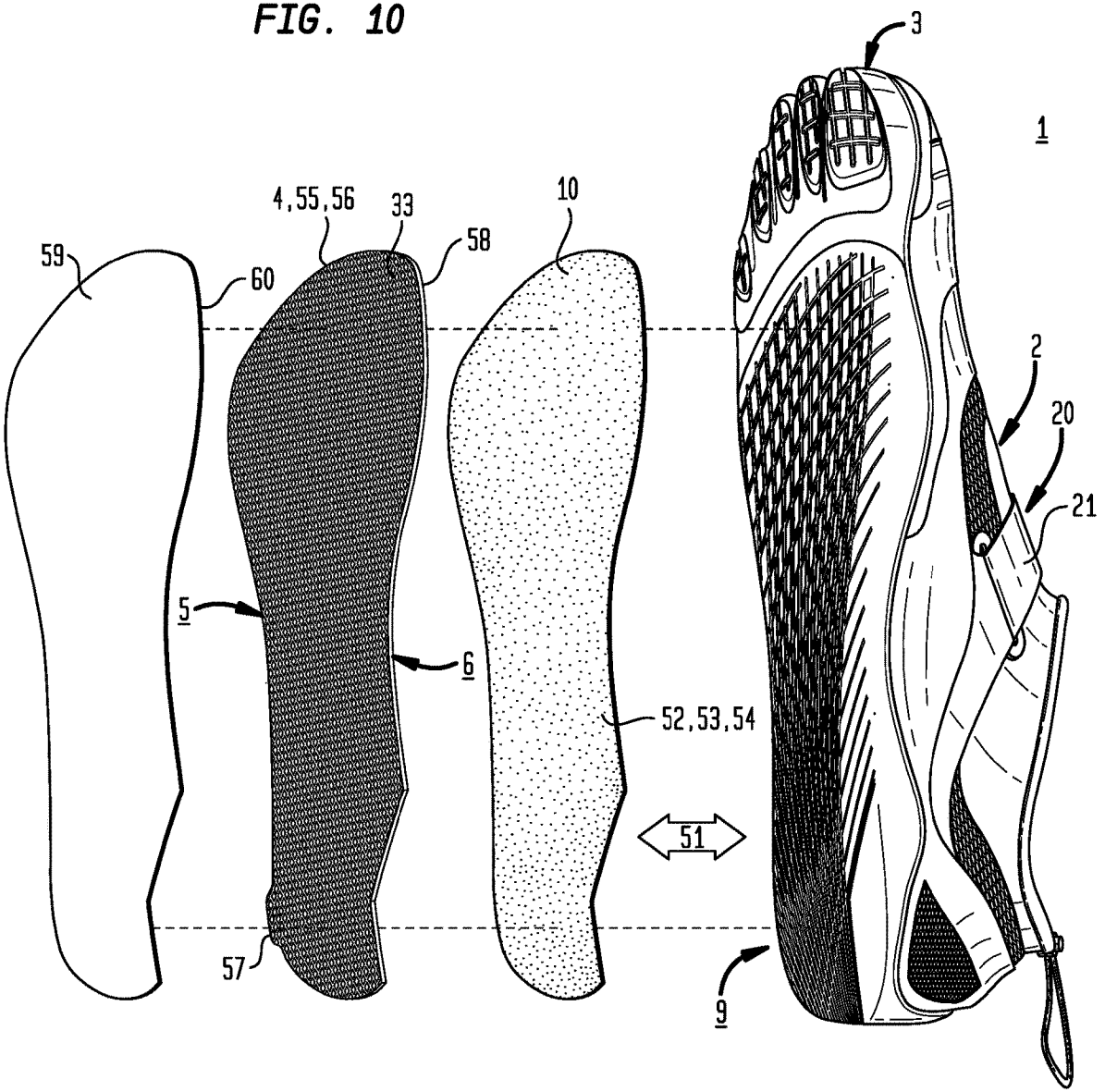
FIG. 10 is an exploded view of a particular embodiment of a shoe including a pliable layer, nonslip layer, and a rigid layer.
Figure 11:
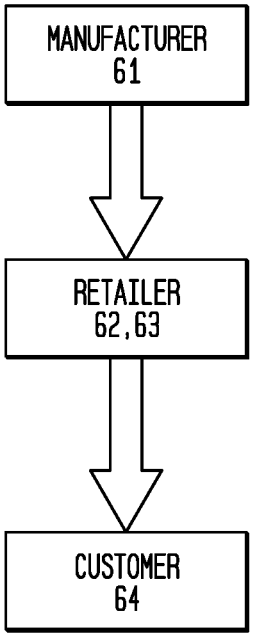
FIG. 11 is a schematic depicting a particular method of transporting a particular embodiment of a shoe including a pliable layer.

Now referring to FIGS. 9 and 10, particular embodiments of the shoe (1) can include an adhesive layer (10). The adhesive layer (10) can be disposed on the first surface (5) or the second surface (6) of the pliable layer (4). In other particular embodiments, the adhesive layer (10) can be disposed on the ground engageable surface (9) of the outsole (3). The adhesive layer (10) can generate a peel adhesion (51) between the pliable layer (4) and the ground engageable surface (9) of the outsole (3) sufficient to avoid peeling of the pliable layer (4) from the outsole (3) during transportation of the shoe (1). In particular embodiments, the adhesive (52) of the adhesive layer (10) can be a single-use adhesive (53) or a multiple-use adhesive (54). In the use of a single-use adhesive (53), the pliable layer (4) conformably peelably adhered to the ground engageable surface (9) of the outsole (3) can be a single use pliable layer (55). The single use pliable layer (55) can be peeled from the ground engageable surface (9) of the outsole (3). Once peeled from the ground engageable surface (9) of the outsole (3), the single use pliable layer (55) cannot be capable of re-adhering to the ground engageable surface (9) of the outsole (3). In particular embodiments, the single-use adhesive (52) leaves little or no residue on the ground engageable surfaces (9) of the outsole (3). In other particular embodiments, the pliable layer (4) conformably peelably adhered to the ground engageable surface (9) of the outsole (3) can be a multiple-use pliable layer (56). The multiple-use pliable layer (56) can be peeled from the ground engageable surface (9) of the outsole (3). Once peeled from the ground engageable surface (9) of the outsole (3), the multiple-use pliable layer (56) can be capable of re-adhering to the ground engageable surface (9) of the outsole (3).

Figure 8:
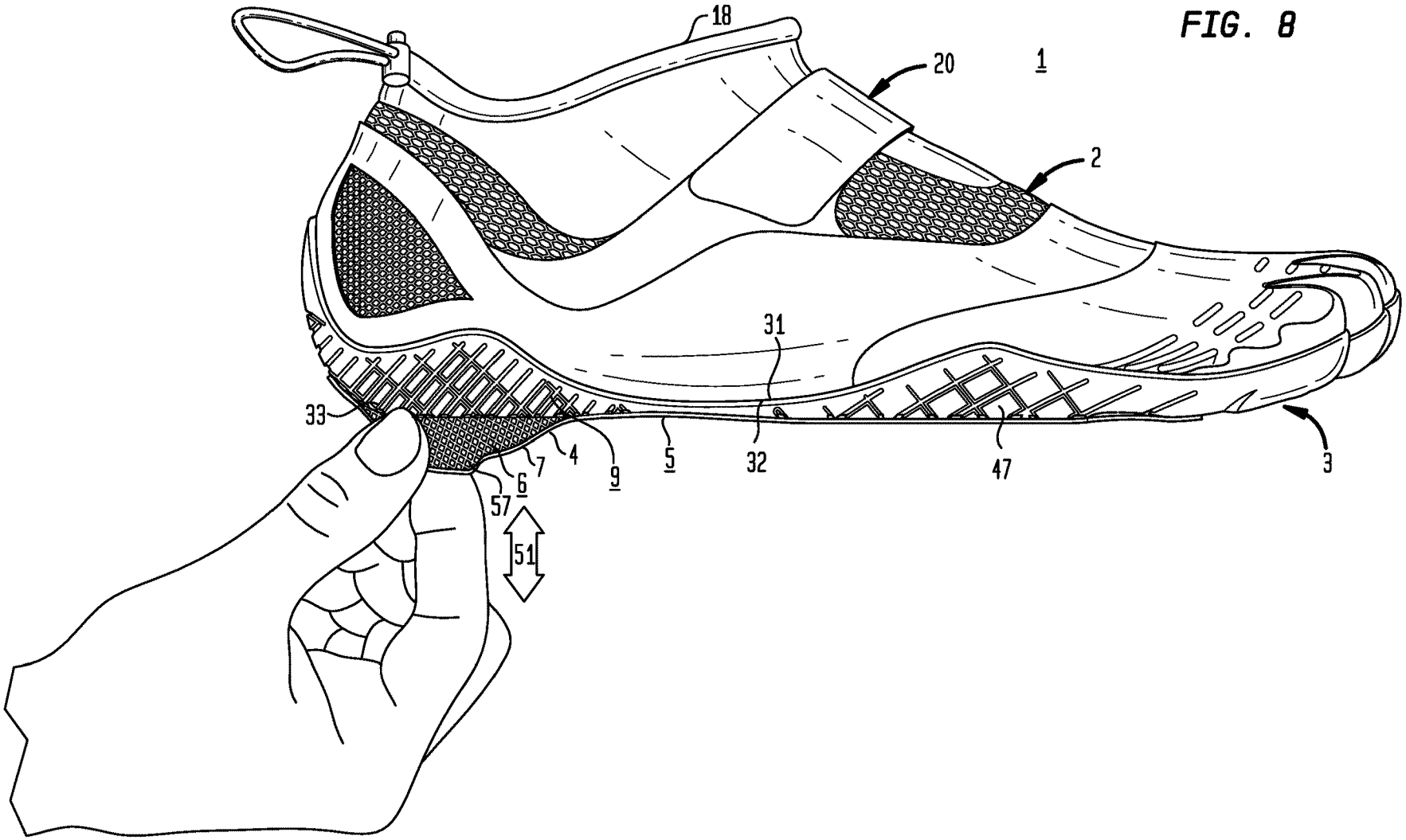
FIG. 8 is an illustration of a particular method of peeling a pliable layer from the ground engagable surface of an outsole of a shoe.

Now referring primarily to FIGS. 8 through 10, in particular embodiments, a tab (57) can extend from the pliable layer periphery (7). The tab (57) can be grippable to provide for peelable removal of the pliable layer (4) from the ground engageable surface (9) of the outsole (3) of the shoe (1). The peel adhesion (51) of the adhesive layer (10) can be about 0 N/m to about 814 N/m. In particular embodiments, the peel adhesion can be selected from the group consisting of: about 5 N/m to about 50 N/m, about 25 N/m to about 75 N/m, about 50 N/m to about 100 N/m, about 75 N/m to about 125 N/m, about 100 N/m to about 150 N/m, about 125 N/m to about 175 N/m, about 150 N/m to about 200 N/m, about 175 N/m to about 225 N/m, about 200 N/m to about 250 N/m, about 225 N/m to about 275 N/m, about 250 N/m to about 300 N/m, about 275 N/m to about 325 N/m, about 300 N/m to about 350 N/m, about 325 N/m to about 375 N/m, about 350 N/m to about 400 N/m, about 375 N/m to about 425 N/m, about 400 N/m to about 450 N/m, about 425 N/m to about 475 N/m, about 450 N/m to about 500 N/m, about 475 N/m to about 525 N/m, about 500 N/m to about 550 N/m, about 525 N/m to about 575 N/m, about 550 N/m to about 600 N/m, about 575 N/m to about 625 N/m, about 600 N/m to about 650 N/m, about 625 N/m to about 675 N/m, about 650 N/m to about 700 N/m, about 675 N/m to about 725 N/m, about 700 N/m to about 750 N/m, about 725 N/m to about 775 N/m, about 750 N/m to about 800 N/m, about 775 N/m to about 810 N/m, or combinations thereof. The adhesive (52) can be selected from the group including: rubber adhesives, acrylic adhesives, silicone adhesives, emulsion-based adhesives, solvent-based adhesives, hot melt adhesives, peelable adhesives, ultra-peelable adhesives, pressure-sensitive adhesives, UV adhesives, or combinations thereof.

Again, referring to FIGS. 1 through 10, the pliable layer (4) can be conformably peelably adhered to the ground engageable surface (9) of the outsole (3) of the shoe (1), where the adhesive layer (10) is disposed between the pliable layer (4) and the ground engageable surface (9) of the outsole (3). The pliable layer periphery (7) can be disposed in generally matched engagement with the outsole periphery (8) of the ground engageable surface (9) of the outsole (3).

Again, referring to FIGS. 1 through 10, particular embodiments of the shoe (1) can, but need not necessarily, include a non-slip layer (58). The non-slip layer (58) can be disposed on the first surface (5) or second surface (6) of the pliable layer (4) opposite the adhesive layer (10). In particular embodiments including a pliable layer (4) of a generally uniform sheet of material (33), the non-slip layer (58) can be disposed over the entirety of the generally uniform sheet of material (33) or a portion of the generally uniform sheet of material (33). In further particular embodiments including a pliable layer (4) of a plurality of patterned surface elements (35) which can be a raised thickness pliable layer pattern (36), the non-slip layer (58) can be disposed on the central portions (37) of the patterned surface elements (35). In yet further particular embodiments including a pliable layer (4) of a plurality of patterned surface elements (35) which can be a reduced thickness pliable layer pattern (40), the non-slip layer (58) can be disposed on each of the patterned wall elements (42). The non-slip layer (58) can be a layer of material which increases friction between the first or second surface (5)(6) of the pliable layer (4) and the support surface (24) or ground (25). The non-slip layer (58) can be selected from the group consisting of: polyvinyl chloride, polyurethane, neoprene, nitrile, rubber, or like materials, or a combination thereof.

Now referring to FIG. 10, particular embodiments of the shoe (1) can, but need not necessarily, include a rigid layer (59). The rigid layer (59) can increase the stiffness of the pliable layer (4) to assist in placement of the pliable layer (4) on the ground engageable surface (9) of the outsole (3). The rigid layer (59) can be disposed on the first or second surface (5)(6) of the pliable layer (4) opposite the adhesive layer (10). Disposed between the rigid layer (59) and the pliable layer (4) can be a thin film of a releasably adhering adhesive (60). The releasably adhering adhesive (60) can be an acrylic adhesive, rubber adhesive, silicone adhesive, pressure sensitive adhesive, or combination thereof, or like material. The rigid layer (59) can be a silicone coated paper or filmic material, or other like material having a stiffness greater than the pliable layer (4).

Now referring to FIG. 9, particular embodiments of the shoe (1) can include a pliable layer (4) capable of being adhered to either a left shoe (1) or a right shoe (1). The pliable layer (4) can be a one-piece pliable layer (4) extending to the pliable layer periphery (7). The pliable layer periphery (7) can be configured to provide an outsole engaging first surface (5) adherable in generally matched engagement with the outsole periphery (8) of the ground engagable surface (9) of the left shoe (1) of a pair of shoes (1). The pliable layer periphery (7) can further be configured to simultaneously provide an outsole engaging second surface (6) adherable in generally matched engagement with the outsole periphery (8) of the ground engagable surface (9) of a right shoe (1) of a pair of shoes (1).

With general reference to FIGS. 1 through 11, particular methods can include transporting embodiments of the shoe (1) having an adhered peelable pliable layer (4) from a first location (61) to a second location (62). The method of transporting a shoe (1) can include one or more of conformably peelably adhering a pliable layer (4) to an outsole (3) of a shoe (1), the pliable layer (4) having a first surface (5) opposite a second surface (6) extending to a pliable layer periphery (7) generally to an outsole periphery (8) of the shoe (1), the pliable layer periphery (7) adhered to the outsole (3) in generally matched engagement with the outsole periphery (8) of the shoe (1), transporting the shoe (1) from a first location (61) at which the shoe (1) can be manufactured to a second location (62) at which the shoe (1) can be sold (also referred to as the point of purchase (63)), and peelably removing the pliable layer (4) from the outsole (3) of the shoe (1) whether before or after the shoe (1) has been worn by the purchaser (64). The point of purchase (63) can be a physical location where a purchaser of the shoe (1) consummates a transaction of purchasing the shoe (1). Non-limiting examples of a point of purchase (63) can include a residence, a retail store, a delivery address, or other location where the ownership of the shoe (1) can be transferred to a purchaser (64). There is a substantial advantage in the method of transporting embodiments of the shoe (1) in that the ground engageable surface (9) of the outsole (3) can be protected from wear or foreign matter during temporary use of the shoe (1) for promotion and sales purposes prior to purchase by the purchaser (64).

In further particular methods of transporting the shoe (1), the shoe (1) can be a plurality of shoes. The method can include conformable peelably adhering a pliable layer (4) to each outsole (3) of the plurality of shoes.

As can be easily understood from the foregoing, the basic concepts of the present invention may be embodied in a variety of ways. The invention involves numerous and varied embodiments of a shoe and methods for making and using such a shoe including the best mode.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of an "adhesive" should be understood to encompass disclosure of the act of "adhering"—whether explicitly discussed or not—and, conversely, were there effectively disclosure of the act of "adhering", such a disclosure should be understood to encompass disclosure of an "adhesive" or even a "means for adhering." Such alternative terms for each element or step are to be understood to be explicitly included in the description.

In addition, as to each term used, it should be understood that unless its utilization in this application is inconsistent with such interpretation, common dictionary definitions should be understood to be included in the description for each term as contained in the Random House Webster's Unabridged Dictionary, second edition, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment. The term "about" generally refers to a range of numeric values that one of skill in the art would consider equivalent to the recited numeric value or having the same function or result. Similarly, the antecedent "substantially" means largely, but not wholly, the same form, manner or degree and the particular element will have a range of configurations as a person of ordinary skill in the art would consider as having the same function or result. When a particular element is expressed as an approximation by use of the antecedent "substantially," it will be understood that the particular element forms another embodiment.

Moreover, for the purposes of the present invention, the term "a" or "an" entity refers to one or more of that entity unless otherwise limited. As such, the terms "a" or "an", "one or more" and "at least one" can be used interchangeably herein.

Thus, the applicant(s) should be understood to claim at least: i) each of the shoes herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

Additionally, the claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

We claim:

1. A pair of shoes, comprising:

an upper secured to an outsole of each one of said pair of shoes;

a one-piece pliable layer including:

an outsole engaging first surface adherable in generally matched engagement with said outsole periphery of said ground engaging surface of a left shoe of said pair of shoes;

an outsole engaging second surface adherable in generally matched engagement with said outsole periphery of said ground engaging surface of a right shoe of said pair of shoes;

an adhesive layer disposed on said first surface or said second surface of said pliable layer or on said ground engageable surface of said outsole of said shoe, said pliable layer conformably peelably adhered to said ground engageable surface of said outsole of said left shoe or said right of said pair of shoes, said pliable layer periphery disposed in generally matched engagement with said outsole periphery of said ground engageable surface of said outsole.

2. The pair of shoes of claim 1, wherein said pliable layer comprises a generally uniform sheet of material.

3. The pair of shoes of claim 2, wherein said generally uniform sheet material sufficiently thin or transparent to allow visualization of said ground engageable surface of said outsole through said pliable laver.

4. The pair of shoes of claim 3, wherein said generally uniform sheet material sufficiently thin or transparent to allow visualization of a sole pattern on said ground engageable surface of said outsole.

5. The pair of shoes of claim 2, wherein a generally uniform sheet of material is selected from the group consisting of: velvet, cotton, knit fabric, woven fabric, suede, nylon, rayon, linen, polyurethane, canvas, jersey, silk, lace, netted fabric, wool, synthetic fabric, tweed, jacquard, leather, microfiber, poplin, fleece, or a combination thereof.

6. The pair of shoes of claim 1, wherein said adhesive layer disposed on said first surface or said second surface of said pliable layer or on said ground engageable surface of said outsole of said pair of shoe does not re-adhere to said ground engageable surface upon said pliable layer peeled from said ground engageable surface of said outsole of said pair of shoes.

7. The pair of shoes of claim 1, further comprising a plurality of patterned surface elements disposed in said first surface or said second surface of said pliable layer, wherein said plurality of patterned surface elements comprise a reduced thickness of said pliable layer.

8. The pair of shoes of claim 7, wherein said plurality of pattered surface elements comprises a plurality of apertures open to said first surface and said second surface of said pliable layer.

9. The pair of shoes of claim 8, wherein said plurality of patterned surface elements having said reduced thickness of said pliable layer or said plurality of apertures allows visualization of said sole pattern on said ground engageable surface of said outsole through said pliable layer.

10. The pair of shoes of claim 7, further comprising disposing a plurality of non-slip patterned surface elements on said first surface or said second surface of said pliable layer.

11. The pair of shoes of claim 1, further comprising disposing a non-slip layer on said first surface or said second surface of said pliable layer.

12. The pair of shoes of claim 1, further comprising a tab extending from said pliable layer periphery, said tab grippable for peelable removal of said pliable layer from said ground engagable surface of outsole of said shoe.

13. The pair of shoes of claim 1, wherein said adhesive layer disposed on said first surface or said second surface of said pliable layer or on said ground engageable surface of said outsole of said pair of shoes generates a peel adhesion between said pliable layer and said ground engagable surface of said outsole, said peel adhesion sufficient to avoid peeling of said pliable layer from said outsole during transit of said shoes.

14. The pair of shoes of claim 13, wherein said peel adhesion of about 0 N/m to about 814 N/m.

15. The pair of shoes of claim 14, wherein said adhesive selected from the group consisting of: rubber adhesives, acrylic adhesives, silicone adhesives, emulsion-based adhesives, solvent-based adhesives, hot melt adhesives, peelable adhesives, ultra-peelable adhesives, pressure-sensitive adhesives, UV adhesives, or combinations thereof.

* * * * *